US006150806A

United States Patent [19]

Canard et al.

[11] Patent Number: 6,150,806

[45] Date of Patent: Nov. 21, 2000

[54] CONTROLLED CURRENT SOURCE FOR ACCELERATED SWITCHING

[75] Inventors: David Canard, Caen; Vincent Fillatre, Thaon, both of France

[73] Assignee: U.S. Philips Corporation, New York, N.Y.

[21] Appl. No.: 09/376,862

[22] Filed: Aug. 18, 1999

[30] Foreign Application Priority Data

Aug. 18, 1998 [FR] France ..... 98 10509

[51] Int. Cl.[7] ..... G05F 1/565; G05F 3/20

[52] U.S. Cl. ..... 323/315; 323/275

[58] Field of Search ..... 323/315, 316, 323/303, 314, 281, 275; 363/59, 60; 330/257, 253

[56] References Cited

U.S. PATENT DOCUMENTS

| | | | |
|---|---|---|---|
| 4,740,766 | 4/1988 | Metz | 323/316 |
| 5,412,309 | 5/1995 | Uenten | 323/316 |
| 5,453,680 | 9/1995 | Giolma et al. | 323/315 |
| 5,506,543 | 4/1996 | Yung | 330/253 |
| 5,508,702 | 4/1996 | Estrada et al. | 341/136 |
| 5,581,174 | 12/1996 | Fronen | 323/316 |
| 5,867,035 | 2/1999 | Nishimura | 323/315 |
| 5,883,507 | 3/1999 | Yin | 323/316 |
| 5,990,711 | 11/1999 | Sekimoto | 327/112 |

FOREIGN PATENT DOCUMENTS

| | | | |
|---|---|---|---|
| 0438039A1 | 7/1991 | European Pat. Off. | H03L 7/08 |
| 0561456A1 | 9/1993 | European Pat. Off. | G05F 3/26 |
| 0670629A1 | 2/1995 | European Pat. Off. | H03D 13/00 |

OTHER PUBLICATIONS

IBM Technical Disclosure Bulletin, vol. 16, No. 6, Nov. 1973; entitled "Current Sources For a Phase–Locked Loop", D.J. Malone.

*Primary Examiner*—Peter S. Wong
*Assistant Examiner*—Bao Q. Vu
*Attorney, Agent, or Firm*—Daniel J. Piotrowski

[57] ABSTRACT

A controlled current source is disclosed which receives a control signal and supplies a current at an output. The current source includes a power module having a plurality of parallel-arranged power transistors, whose collectors are jointly connected to the output of the current source, a control module to receive the control signal, and an output to supply a signal enabling the power transistors to be turned on, wherein, the emitters of the power transistors are jointly connected to the output of the control module, the output for supplying a current whose value depends on the value of the control signal, the bases of the power transistors being permanently subjected to a voltage of a predetermined value enabling the power transistors to be rendered potentially conducting. By pre-charging the parasitic capacitances of the power transistors, the transistors are turned on at an accelerated rate.

7 Claims, 3 Drawing Sheets

CONTROLLED CURRENT SOURCE FOR ACCELERATED SWITCHING

Figure 1:
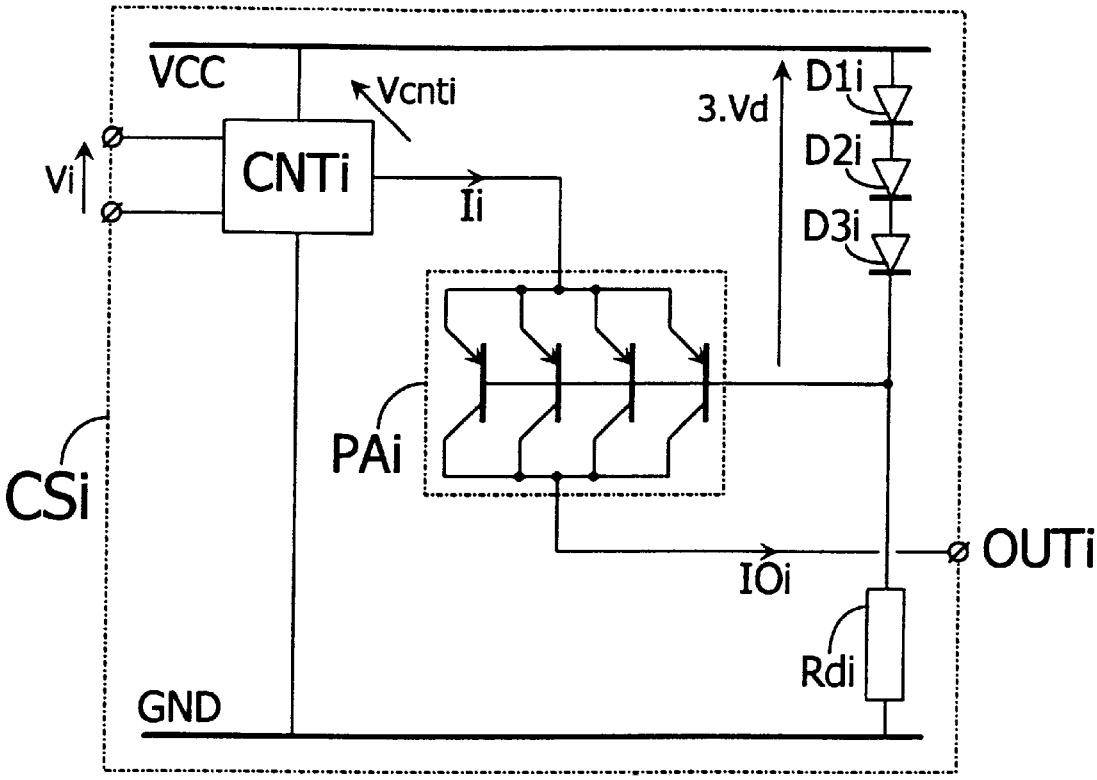

The invention relates to a controlled current source having a control input intended to receive a control signal, and an output intended to supply a current whose value depends on the value of the control signal, comprising:

a plurality of parallel-arranged power transistors each having a reference terminal, a transfer terminal and a bias terminal, the transfer terminals of the power transistors being jointly connected to the output of the current source, and a control module having an input intended to receive the control signal, and an output intended to supply a signal enabling the power transistors to be turned on.

Such current sources are frequently used for constructing charge pumps intended to supply current pulses for controlling a charge or a discharge of capacitive elements in phase-locked loops effecting a frequency control of a signal supplied by a voltage-controlled oscillator. Such a phase-locked loop is particularly described in European patent application no. 0 670 629 A1. The charge pump included in this loop uses controlled current sources of the type described in the opening paragraph, in which the power transistors are of the PNP type, their bases, emitters and collectors constituting bias, reference and transfer terminals, respectively. These power transistors are biased by means of an emitter current which is permanently supplied via a positive power supply terminal, and they are turned on by the control module by means of an appropriate base voltage when the control signal so orders the control module. The power transistors convey the bias current from their emitters to their collectors and to the output of the controlled current source.

The power transistors must be turned on very rapidly, particularly when the output signal of the oscillator has a high frequency, for example, of the order of GHz, in which case the frequency at which the power transistors change from a blocked state to a saturated state, referred to as switching frequency, may then be of the order of MHz. The nominal value of the current supplied by the controlled current source, when being conducting, is often important. For building each controlled current source, this leads to the use of several transistors whose dimensions are large with regard to those of other transistors included in the phase-locked loop. Such structures have considerable parasitic capacitances, particularly at the collector-base junctions, which delay the instant when the power transistors are effectively turned on and cause alterations in the form of the current pulses supplied by the controlled current source, which alterations essentially consist of positive and negative current peaks during the power transistors switching.

It is one of the objects of the invention to remedy these drawbacks to a great extent by proposing a controlled current source within which the influence of the power transistors parasitic capacitances is minimized considerably.

To this end, a controlled current source as described in the opening paragraph is characterized in that the reference terminals of the power transistors are jointly connected to the output of the control module, said output being intended to supply a current whose value depends on the value of the control signal, the bias terminals of the power transistors being permanently subjected, in the operative state of the current source, to a voltage of a predetermined value enabling said power transistors to be rendered rendered potentially conducting.

In such a controlled current source, the bias voltage applied to the bias terminals of the power transistors effects, as it were, a pre-charging of the parasitic capacitances of said transistors and renders these transistors potentially conducting. It will thus be sufficient to present a current to their reference terminals so that they become effectively conducting, and this in a quasi-instantaneous manner. Besides, since the parasitic capacitances are pre-charged, they are not subjected to voltage discontinuities, contrary to what happens in the known controlled current source. The alterations in the shape of the output current of the controlled current source, due to switching of the power transistors, are thus considerably attenuated in the controlled current source according to the invention.

In one of its embodiments, a controlled current source as described above is characterized in that the control module comprises a first and a second transistor constituting a first differential pair and intended to receive the control signal at their bias terminals, and a third transistor whose main current path is arranged, in series with a first resistor, between a positive power supply terminal and the output of the control module, the transfer terminal of the first transistor being connected to the positive power supply terminal, the transfer terminal of the second transistor being connected to the positive power supply terminal via a second resistor, on the one hand, and to the bias terminal of the third transistor, on the other hand.

This embodiment is advantageous by virtue of its simplicity, using a limited number of components. Besides, it will be proved hereinafter that the nominal value of the output current of such a controlled current source depends directly on the value of the first resistor, which allows a simplified calibration of said output current of the source.

In a variant of the embodiment described above, the control module also comprises a fourth and a fifth transistor constituting a second differential pair and intended to receive a selection signal at their bias terminals, the transfer terminal of the fourth transistor being connected to the positive power supply terminal, the transfer terminal of the fifth transistor being connected to the positive power terminal via a voltage-regulating element, on the one hand, and to the bias terminal of the third transistor via a third resistor, on the other hand.

It will be proved hereinafter that such a variant allows selection of a nominal value for the output current from two predetermined values, thus enabling the controlled current source to bring about charges or discharges of capacitive elements to a larger or smaller extent.

In a particular embodiment of this variant of the invention, the voltage-regulating element is constituted by a diode.

As described above, two current sources according to the invention may be advantageously used for building a charge pump. The invention thus also relates to a charge pump having two control inputs intended to receive control signals, and an output intended to supply an output current whose direction and value depend on the values of the control signals, characterized in that it comprises a first and a second controlled current source as described hereinbefore, whose control inputs constitute the control inputs of the charge pump, the outputs of the first and second current sources being connected to the first and the second branch of a current mirror, the output of one of the current sources being also connected to the output of the charge pump.

In accordance with an advantageous embodiment, such a charge pump also comprises a draining current source intended to permanently supply, in the operative state of the charge pump a current whose nominal value is negligible with regard to the maximum value of the output current of the charge pump, the draining current source being arranged between that output of the first and second current sources which is not connected to the output of the charge pump, and a negative power supply terminal.

The draining current source allows evacuation of electric charges stored in transistors constituting the current mirror, which prevents a parasitic leakage current from appearing in one of the branches of said current mirror for evacuating these charges towards the negative power supply terminal, after the conductance of the first current source has been interrupted. Such a leakage current would cause the persistence of a negative current at the output of the charge pump, a phenomenon which is all the more prohibition as the switching frequency of the charge pump is higher.

Such a charge pump may be advantageously used in a phase-locked loop. Such loops are currently applied for performing frequency conversions in radioelectric signal receivers such as, for example, televisions or radiotelephones. The invention thus also relates to an apparatus for receiving radioelectric signals, comprising an antenna and filtering system allowing reception of a signal whose frequency is selected within a given range of frequencies, and its transformation into an electronic signal referred to as radio signal, in which apparatus a frequency conversion from the selected frequency to a predetermined intermediate frequency is performed by means of a mixer intended to receive the radio signal, on the one hand, and an output signal of a local oscillator whose frequency is determined by the value of a tuning voltage, on the other hand, said apparatus also comprising a phase/frequency detector intended to compare the frequency of the output signal of the oscillator with that of a reference signal and to supply, to a charge pump, control signals whose values depend on the result of said comparison, the output of the charge pump being connected to a capacitor intended to generate the tuning voltage at its terminals, characterized in that the charge pump is a charge pump as described above.

These and other aspects of the invention are apparent from and will be elucidated, by way of non-limitative example, with reference to the embodiment(s) described hereinafter.

IN THE DRAWINGS

Figure 2:
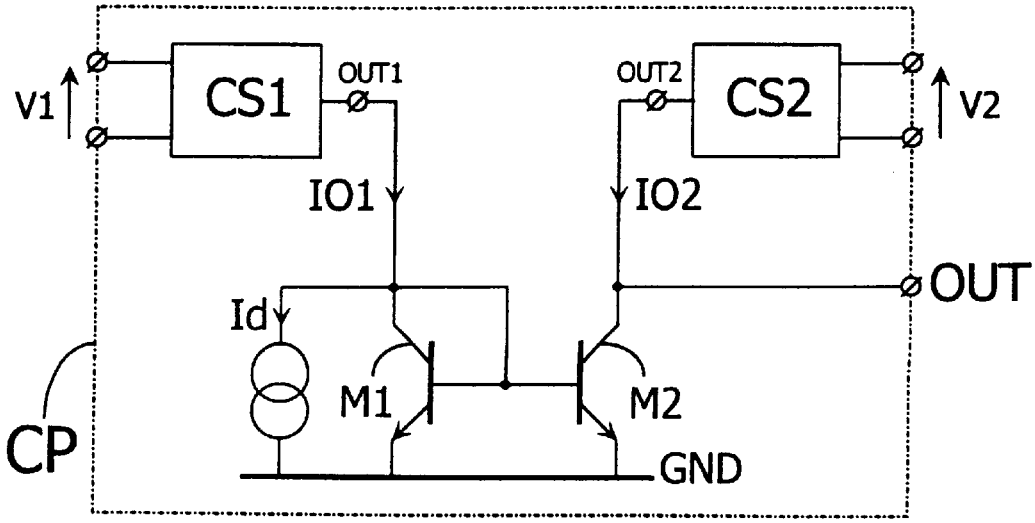
Figure 3:
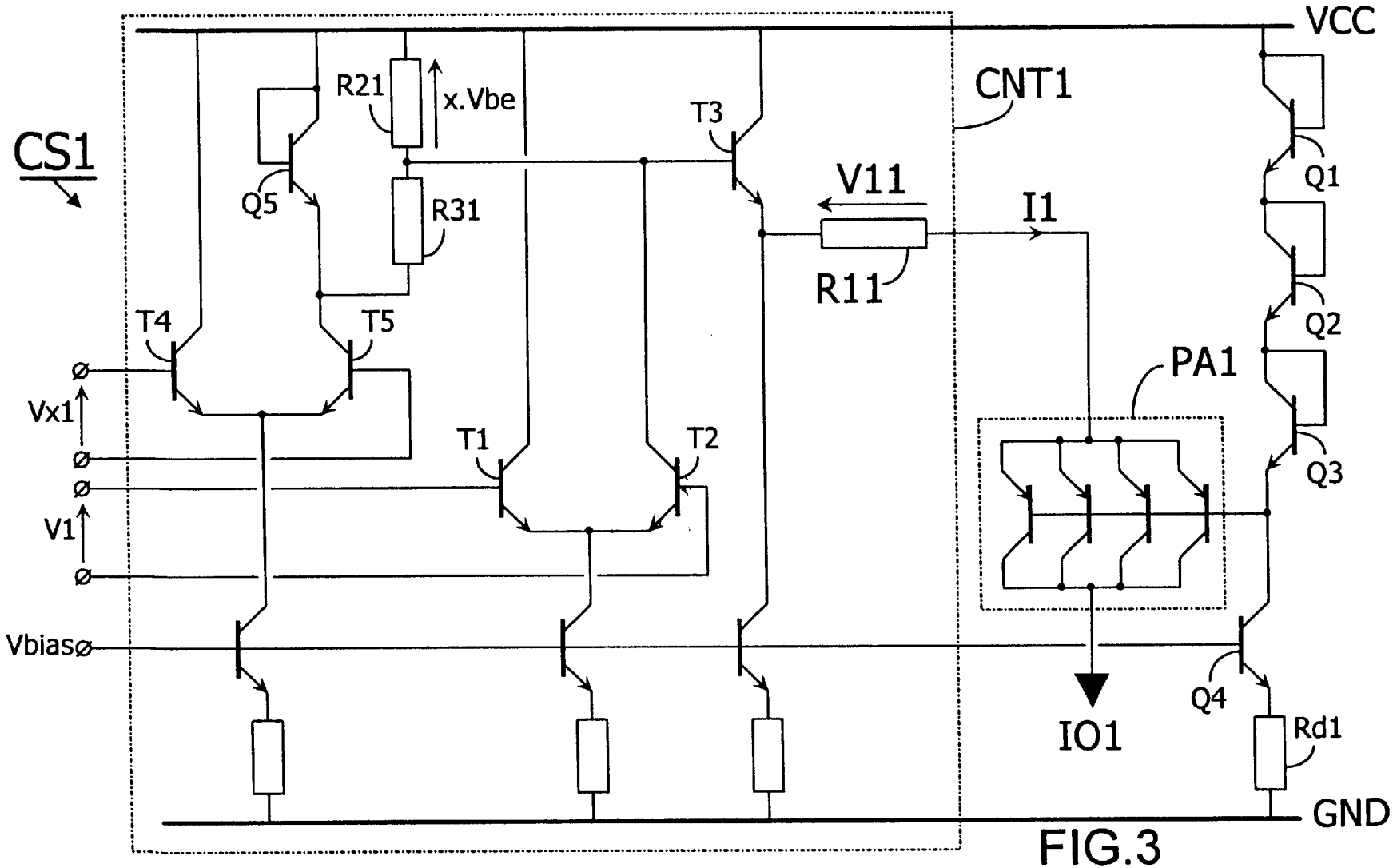
Figure 4:
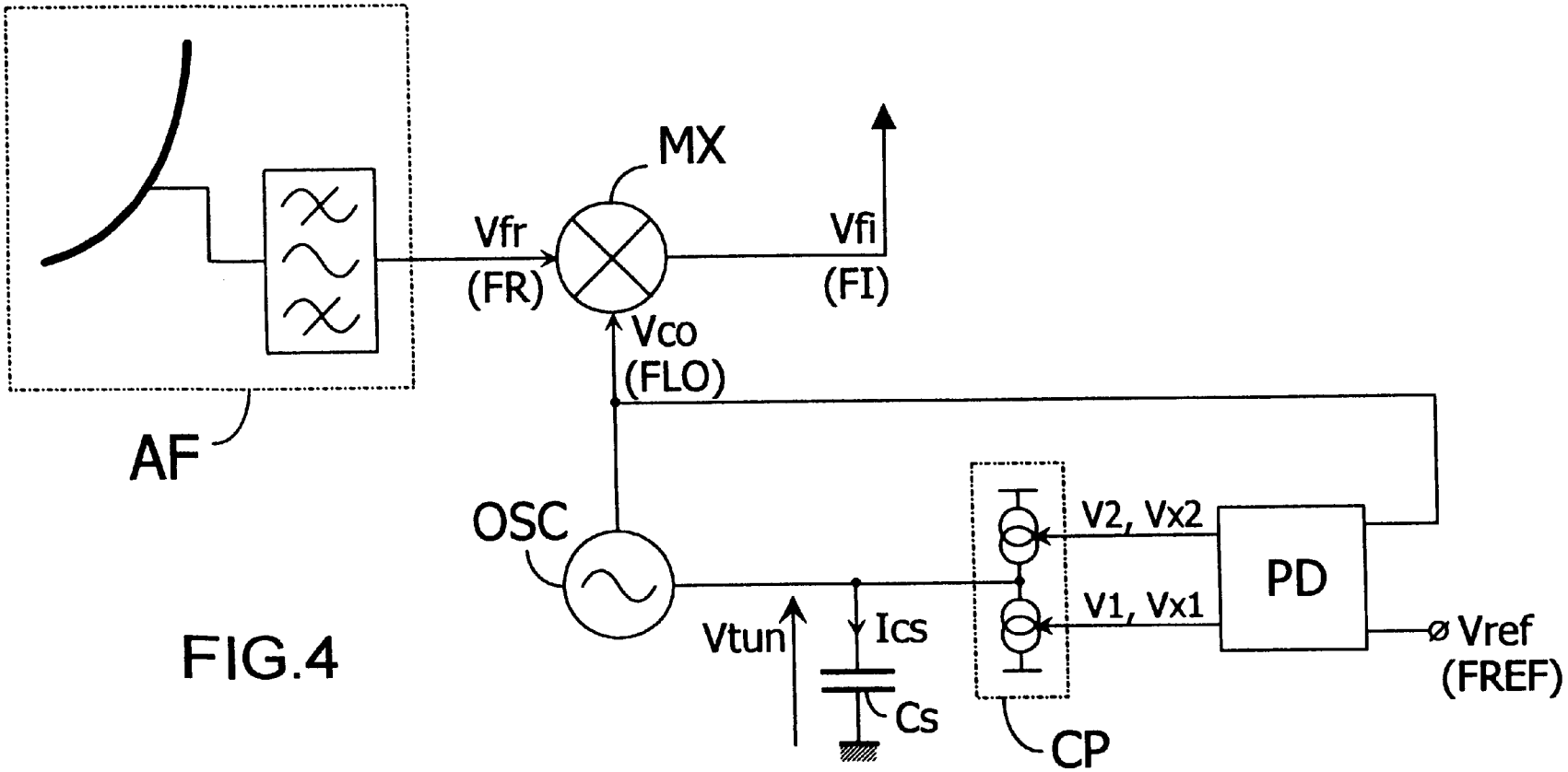

FIG. 1 is an electric circuit diagram of a controlled current source according to the invention, FIG. 2 is a functional circuit diagram of a charge pump incorporating such current sources, FIG. 3 is an electric circuit diagram of a controlled current source in accordance with a preferred embodiment of the invention, and FIG. 4 is a partial functional circuit diagram of an apparatus for receiving radioelectric signals, using the invention.

FIG. 1 shows diagrammatically a controlled current source CSi having a control input intended to receive a control signal Vi, and an output OUTi intended to supply a current IOi whose value depends on the value of the control signal Vi. The value of this current IOi may be, for example, zero as long as the value of the control signal Vi is negative or zero, and may be equal to a predetermined non-zero nominal value when the value of the control signal is positive. In the example described here, the control signal Vi is constituted by a voltage. The controlled current source CSi comprises:

a power module PAi comprising a plurality of parallel-arranged power transistors, each transistor having a reference terminal, a transfer terminal and a bias terminal, the transfer terminals of the power transistors being jointly connected to the output of the current source, and a control module CNTi having an input intended to receive the control signal Vi, and an output intended to supply a signal enabling the power transistors to be turned on.

In the example described in this Figure, the power transistors are bipolar transistors of the PNP type. Their reference terminals, transfer terminals and bias terminals are constituted by their emitters, collectors and bases, respectively. The emitters of the power transistors are jointly connected to the output of the control module CNTi, while their bases are permanently subjected, in the operative state of the current source Csi, to a predetermined voltage VCC-3. Vd. This voltage is generated by means of the assembly of three diodes D1*i*, D2*i* and D3*i*, arranged in series with a resistor Rdi, between a positive power supply terminal VCC and a negative power supply terminal GND which may be materialized by the circuit ground. The voltage generated by the three diodes D1*i*, D2*i* and D3*i* is equal to 3.Vd, where Vd is the threshold voltage of a diode. The emitter-base voltage of the power transistors is thus equal to 3 Vd-Vcnti, where Vcnti represents a voltage drop generated by the control module GNTi. As will be explained hereinafter, the components constituting the controlled current source CSi can easily be dimensioned in such a way that 3 Vd-Vcnti>$Veb_{th}$, where $Veb_{th}$ represents the minimal value which the emitter-base voltage of the power transistors must assume to enable them to conduct. The bias voltage VCC-3. Vd applied to the bases of the power transistors then effects, as it were, a pre-charging of the parasitic capacitances of said transistors and renders these transistors potentially conducting. In this configuration, it will thus be sufficient to present a current II to their emitters to cause said transistors to conduct effectively, and this in a quasi-instantaneous manner.

FIG. 2 is a functional circuit diagram of a charge pump CP incorporating two current sources of the type described above. This charge pump CP has two control inputs intended to receive control signals V1 and V2, and an output OUT intended to supply an output current whose direction and value depend on the values of the control signals V1 and V2. The charge pump CP comprises a first controlled current source CS1 and a second controlled current source CS2 of the type described above, whose control inputs constitute the control inputs of the charge pump CP, the outputs OUT1 and OUT2 of the first and second current sources being connected to the first and the second branch of a current mirror (M1, M2), the output of the second current source CS2 being also connected to the output OUT of the charge pump CP. The current mirror (M1, M2) is constituted by two transistors, M1 and M2, whose collectors form the first and the second branch, respectively, of the current mirror, whose bases are jointly connected to the collector of the first transistor M1, and whose emitters are connected to a negative power supply terminal GND. When the control signal V2 of the second controlled current source CS2 so orders, said source CS2 conveys a current IO2. As the first current source CS1 does not convey a current, the output current IO2 of the second current source CS2 is directed towards the output OUT of the charge pump CP which thus supplies a positive current. Conversely, if the control signal V1 of the first controlled current source CS1 orders the conductance of said source CS1, this source supplies a current IO1 at the first branch of the current mirror (M1, M2), which current mirror then reproduces said current IO1 at its second branch.

As the second current source CS2 does not convey a current, the current flowing in the second branch of the current mirror (M1, M2), which is the image of current IO1, is taken from the output OUT of the charge pump CP, which thus supplies a negative current. The charge pump CP also comprises a draining current source arranged between the output of the first current source CS1 and the negative power supply terminal GND. This current source is intended to permanently supply, in the operative state of the charge pump CP, a current Id, whose nominal value is negligible with regard to the maximum value of the output current IO1 or IO2 of the charge pump CP. The draining current source allows evacuation of electric charges stored in parasitic capacitances in the transistors M1 and M2 constituting the current mirror (M1, M2), which prevents a parasitic leakage current from appearing in one of the branches of said current mirror for evacuating these charges to the negative power supply terminal GND, after the conductance of the first current source CS1 has been interrupted. Such a leakage current would cause the persistence of a negative current at the output OUT of the charge pump CP, a phenomenon which is all the more prohibitive as the switching frequency of the charge pump CP is higher.

FIG. 3 shows diagrammatically a controlled current source CS1 in accordance with a preferred embodiment of the invention. In so far as is possible, identical reference numerals are used for denoting the elements which are common with the current source described hereinbefore. In this controlled current source CS1, the control module CNT1 comprises a first transistor T1 and a second transistor T2 forming a first differential pair and intended to receive the control voltage V1 at their bases, and a third transistor T3, whose main current path, i.e. the collector-emitter path, is arranged in series with a first resistor R11, between a positive power supply terminal VCC and the output of the control module CNT1, the emitter of the first transistor T1 being connected to the positive power supply terminal VCC, the collector of the second transistor T2 being connected to the positive power supply terminal VCC via a second resistor R21, on the one hand, and to the base of the third transistor T3, on the other hand. The control module CNT1 also comprises a fourth transistor T4 and a fifth transistor T5 forming a second differential pair, and intended to receive a selection signal Vx1 at their bases, which signal is here constituted by a voltage, the collector of the fourth transistor T4 being connected to the positive power supply terminal VCC, the collector of the fifth transistor T5 being connected to the positive power supply terminal VCC via a transistor Q5 arranged in a diode configuration, on the one hand, and to the base of the third transistor T3 via a third resistor R31, on the other hand. The diodes D1*i*, D2*i* and D3*i* are here constituted by transistors Q1, Q2 and Q3, biased by means of a transistor Q4 arranged in series with the aforementioned transistors, in accordance with a technique which is known to those skilled in the art.

If, in the embodiments herein described, the transistors used are bipolar transistors, it will be evident that transistors of the MOS type, whose gates, drains and sources would constitute the bias terminal, the transfer terminal and the reference terminal, respectively, may be their substitutes.

The current source CS1 operates in the following manner: when the control voltage V1 is negative, the second transistor T2 is turned on while the first transistor T1 is turned off. The third transistor T3 has a voltage follower function and recopies the potential of the base of said third transistor T3 at its emitter with a shift which is equal to a base-emitter voltage. A significant current flows through the second resistor R21 and generates a voltage drop at its terminals, which is sufficiently large for the value of the difference between the potential of the emitter of the third transistor T3 and that of the bases of the power transistors to be less than a minimal value allowing said power transistors to be turned on. The voltage drop at the terminals of the second resistor R21 thus ensures that the power transistors remain turned off. The current I1 supplied by the control module CNT1 is thus zero and the power module PA1 is inactive.

When the value of the control voltage V1 becomes positive, the second transistor T2 is turned off while the first transistor T1 is turned on. The potential of the base of the third transistor T3 will thus be proximate to that of the positive power supply terminal VCC, the potential of the emitter of said third transistor T3 becoming sufficiently high to render the transistor potentially conducting. The third transistor T3 then supplies a non-zero current I1 via the first resistor R11 to the output of the control module CNT1. This current I1 renders the power transistors conducting as soon as it reaches their emitters, and the controlled current source CS1 supplies a non-zero output current IO1. The nominal value of this output current IO1 may be determined as follows: a first loop equation gives $$Vbe(T3)+V11+Veb=Vbe(Q1)+Vbe(Q2)+Vbe(Q3),$$

where Vbe(Ti) and Vbe(Qi) are the base-emitter voltages of the NPN transistors Ti and Qi, respectively, Veb is the emitter-base voltage of the PNP power transistors and V11 is the voltage at the terminals of the first resistor R11. The base-emitter and emitter-base voltages of the various transistors are, by their construction, substantially equal to a value Vbe, which is of the order of 0.6 V. We may thus write V11=Vbe, or, by applying Ohm's law, I1=Vbe/R11. When the selection voltage Vx1 is positive, the output current IO1 of the charge pump CS1 thus has Vbe/R11 as a nominal value. The choice of the value of the first resistor R11 thus allows easy calibration of the output current IO1.

When the selection voltage Vx1 is negative, the reasoning developed above remains applicable, except that the first loop equation is no longer valid. Indeed, a negative selection voltage Vx1 turns on the fifth transistor T5 and turns off the fourth transistor T4. The diode constituted by the transistor Q5 thus becomes conducting and imposes a voltage Vbe on the terminals of the series arrangement of the second and third resistors R21 and R31, which form a voltage divider bridge. A voltage x. Vbe appears at the terminals of the second resistor R21, where x=R21/(R21+R31). A second loop equation thus gives:

$$x.Vbe+Vbe(T3)+V11+Veb=Vbe(Q1)+Vbe(Q2)+Vbe(Q3), \text{ or } V11=Vbe(1-x).$$

Thus we obtain I1=(1−x). Vbe/R11. When the selection voltage is negative, the nominal value of the output current IO1 of the controlled current source CS1 thus represents only a fraction of the nominal value assumed by the output current IO1 when the selection voltage Vx1 is positive. The selection voltage Vx1 thus allows a choice of the nominal value of the output current IO1 from two predetermined values, one being equal to (1−x) times the other. This possibility proves to be interesting in certain applications, such as the one described with reference to the following Figure.

FIG. 4 shows partially an apparatus for receiving radio-electric signals, which apparatus incorporates a charge pump CP constructed on the basis of two controlled current sources CS1 and CS2 of the type described above. This apparatus comprises an antenna and filtering system AF allowing reception of a signal whose frequency is selected from within a given range of frequencies, and its transformation into an electronic signal Vfr, referred to as radio signal, having a frequency FR, referred to as radio frequency. A conversion of the frequency from the selected radio frequency FR to a predetermined intermediate frequency FI is performed in this apparatus by means of a mixer MX intended to receive the radio signal Vfr, on the one hand, and an output signal Vco of a local oscillator OSC, whose oscillation frequency FLO is determined by the value of a tuning voltage Vtun, on the other hand. This apparatus also comprises a phase/frequency detector PD intended to compare the frequency FLO of the output signal Vco of the oscillator OSC with the frequency FREF of a reference signal Vref, and to supply to the charge pump CP control signals V1, V2 and selection signals Vx1, Vx2, whose values depend on the result of said comparison. The output of the charge pump CP is connected to a capacitor Cs intended to generate the tuning voltage Vtun at its terminals.

The mixer MX is designed in such a way that FI=FR−FLO, the value of the intermediate frequency FI being fixed, for example, by means of a filtering device (not shown) arranged at the output of the mixer Mx. The oscillation frequency FLO determines the radio frequency FR of the selected radio signal, because FR=FLO+FI. The choice of the value of the reference frequency FREF, made by the user of the receiver, thus defines the radio signal to be selected. The oscillation frequency FLO is controlled by means of a phase-locked loop incorporating the charge pump CP. This loop operates in the following way: when the oscillation frequency FLO is less than the reference frequency FREF, the phase/frequency detector PD supplies a positive control voltage V2 to the charge pump CP which then supplies a positive output current Ics to the capacitor Cs. The tuning voltage Vtun which is present at the terminals of said capacitor Cs then increases, causing an increase of the value of the oscillation frequency FLO. This cycle is repeated until the oscillation frequency FLO becomes equal to the reference frequency FREF, at which the loop reaches its locked-on state. (This reasoning may be transposed to the case where the oscillation frequency FLO would be higher than the reference frequency FREF, with the phase/frequency detector PD supplying a positive control voltage V1 to the charge pump CP which then controls, by means of a negative output current Ics, a reduction of the value of the tuning voltage Vtun , and thus of the oscillation frequency FLO.) When approaching the locked-on state, i.e. when the phase/frequency detector PD identifies a difference between the frequencies FREF and FLO which are non-zero but smaller than a predetermined threshold, said phase/frequency detector PD can advantageously supply a negative control voltage Vx2 to the charge pump CP, in addition to the positive control voltage V2. This will cause a considerable reduction of the nominal value of the output current Ics of the charge pump CP, which will prevent a large extent overshoots in the correction. Such overshoots occur when a too high value of the output current Ics involves a too strong increase of the tuning voltage Vtun and thus of the value of the oscillation frequency FLO, which becomes higher than the value of the reference frequency FREF, causing the phase/frequency detector PD to order an inversion of the charge pump CP's output current Ics. Such phenomena may lead to an instability of the loop. The reduction of the extent of the corrections obtained by the negative selection voltage Vx2 thus enables the loop to reach its locked-on state more rapidly.

What is claimed is:

1. A controlled current source having a control input intended to receive a control signal, and an output intended to supply a current whose value depends on the value of the control signal, comprising:

a plurality of parallel-arranged power transistors each having a reference terminal, a transfer terminal and a bias terminal, the transfer terminals of the power transistors being jointly connected to the output of the current source, and a control module having an input intended to receive the control signal, and an output intended to supply a signal enabling the power transistors to be turned on, wherein the reference terminals of the power transistors are jointly connected to the output of the control module, said output supplying a current whose value depends on the value of the control signal, the bias terminals of the power transistors being permanently subjected in the operative state of the current source to a voltage of a predetermined value enabling said power transistors to be rendered potentially conducting.

2. A controlled current source as claimed in claim 1, characterized in that the control module comprises a first and a second transistor constituting a first differential pair and intended to receive the control signal at their bias terminals, and a third transistor whose main current path is arranged, in series with a first resistor, between a positive power supply terminal and the output of the control module, the transfer terminal of the first transistor being connected to the positive power supply terminal, the transfer terminal of the second transistor being connected to the positive power supply terminal via a second resistor, on the one hand, and to the bias terminal of the third transistor, on the other hand.

3. A controlled current source as claimed in claim 2, characterized in that the control module also comprises a fourth and a fifth transistor constituting a second differential pair and intended to receive a selection signal at their bias terminals, the transfer terminal of the fourth transistor being connected to the positive power supply terminal, the transfer terminal of the fifth transistor being connected to the positive power terminal via a voltage-regulating element, on the one hand, and to the bias terminal of the third transistor via a third resistor, on the other hand.

4. A controlled current source as claimed in claim 3, characterized in that the voltage-regulating element is constituted by a diode.

5. A charge pump comprising:

two control inputs for receiving control signals, an output intended to supply an output current whose direction and value depend on the values of the control signals, a first and a second controlled current source, each controlled current source including a plurality of parallel-arranged power transistors each having a reference terminal, a transfer terminal and a bias terminal, the transfer terminals of the power transistors being jointly connected to the output of the current source, and a control module having an input coupled to one of said charge pump inputs for receiving the control signal, and an output intended to supply a signal enabling the power transistors to be turned on, wherein the reference terminals of the power transistors are jointly connected to the output of the control module, said output being intended to supply a current whose value depends on the value of the control signal, the bias terminals of the power transistors being permanently subjected in the operative state of the current source to a voltage of a predetermined value enabling said power transistors to be rendered potentially conducting; the outputs of the first and second current sources being connected to the first and the second branch of a current mirror, the output of one of the current sources being also connected to the output of the charge pump.

6. The charge pump as claimed in claim 5, characterized in that it also comprises a draining current source intended to permanently supply, in the operative state of the charge pump a current whose nominal value is negligible with regard to the maximum value of the output current of the charge pump, the draining current source being arranged between that output of the first and second current sources which is not connected to the output of the charge pump, and a negative power supply terminal.

7. An apparatus for receiving radioelectric signals, comprising an antenna and filtering system allowing reception of a signal whose frequency is selected within a given range of frequencies, and its transformation into an electronic signal referred to as radio signal, in which apparatus a frequency conversion from the selected frequency to a predetermined intermediate frequency is performed by means of a mixer intended to receive the radio signal, on the one hand, and an output signal of a local oscillator whose frequency is determined by the value of a tuning voltage, on the other hand, said apparatus also comprising a phase/frequency detector intended to compare the frequency of the output signal of the oscillator with that of a reference signal and to supply, to a charge pump, the charge pump including two control inputs intended to receive control signals, an output intended to supply an output current whose direction and value depend on the values of the control signals, a first and a second controlled current source, each controlled current source having a plurality of parallel-arranged power transistors each having a reference terminal, a transfer terminal and a bias terminal, the transfer terminals of the power transistors being jointly connected to the output of the current source, and a control module having an input coupled to one of said charge pump inputs for receiving the control signal, and an output intended to supply a signal enabling the power transistors to be turned on, wherein the reference terminals of the power transistors are jointly connected to the output of the control module; said output being intended to supply a current whose value depends on the value of the control signal, the bias terminals of the power transistors being permanently subjected in the operative state of the current source to a voltage of a predetermined value enabling said power transistors to be rendered potentially conducting, the outputs of the first and second current sources being connected to the first and the second branch of a current mirror, the output of one of the current sources being also connected to the output of the charge pump, control signals whose values depend on the result of said comparison, the output of the charge pump being connected to a capacitor intended to generate the tuning voltage at its terminals.

* * * * *